US006512908B2

(12) United States Patent
Mitamura

(10) Patent No.: US 6,512,908 B2
(45) Date of Patent: Jan. 28, 2003

(54) DEVELOPING APPARATUS HAVING A CYLINDRICAL SLEEVE FOR HOLDING MAGNETIC TONER AND A MAGNETIC SHAFT ROTATABLE INSIDE THE SLEEVE

(75) Inventor: Hiromichi Mitamura, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/888,480

(22) Filed: Jun. 25, 2001

(65) Prior Publication Data

US 2002/0025198 A1 Feb. 28, 2002

(30) Foreign Application Priority Data

Jul. 12, 2000 (JP) ..... 2000-211529

(51) Int. Cl.[7] ..... G03G 15/09
(52) U.S. Cl. ..... 399/267; 399/276; 399/277
(58) Field of Search ..... 399/267, 276, 399/277

(56) References Cited

U.S. PATENT DOCUMENTS 4,714,046 A * 12/1987 Steele et al. ..... 399/276 X
5,227,848 A * 7/1993 Robinson et al. ..... 399/277 X
5,606,404 A * 2/1997 Hilbert et al. ..... 399/267
5,881,338 A * 3/1999 Armstrong et al. ..... 399/267 X

FOREIGN PATENT DOCUMENTS

JP 58-10453 1/1983

* cited by examiner

*Primary Examiner*—William J. Royer
(74) *Attorney, Agent, or Firm*—Frishauf, Holtz, Goodman & Chick, P.C.

(57) ABSTRACT

A developing apparatus is provided which includes a hollow cylindrical sleeve which is rotationally driven and a magnetic shaft which is rotationally driven inside the sleeve. The magnetic shaft causes magnetic toner to adhere to a peripheral surface of the sleeve by magnetic force. The magnetic toner adhering to the peripheral surface is supplied to a developing position by rotation of the sleeve and adheres to an electrostatic latent image formed on the surface of a photosensitive body. The center of rotation of the magnetic shaft is deviated from the center of rotation of the sleeve nearer to the photosensitive drum, and frontward along the direction of rotation of the sleeve from a line connecting the center of rotation of the sleeve and the center of rotation of the photosensitive body.

12 Claims, 6 Drawing Sheets

DEVELOPING APPARATUS HAVING A CYLINDRICAL SLEEVE FOR HOLDING MAGNETIC TONER AND A MAGNETIC SHAFT ROTATABLE INSIDE THE SLEEVE

CROSS-REFERENCE TO RELATED APPLICATIONS

This application is based upon and claims the benefit of priority from the prior Japanese Patent Application No. 2000-211529, filed Jul. 12, 2000, the entire contents of which are incorporated herein by reference.

BACKGROUND OF THE INVENTION

The present invention relates to a developing apparatus in which magnetic toner is caused to adhere to the peripheral surface of a sleeve, utilizing magnetic force of a magnetic shaft, and an image forming apparatus, such as a laser printer or a copying machine, containing the developing apparatus.

An image forming apparatus, such as a laser printer, comprises: a photosensitive drum having a surface on which an electrostatic latent image is formed; a developing apparatus for developing the electrostatic latent image, thereby forming a toner image; and a transferring apparatus for transferring the toner image to a recording paper sheet.

Conventionally, a developing apparatus, in which magnetic toner is supplied to the photosensitive drum via a developing roller, is known as the developing apparatus for use in the aforementioned image forming apparatus. This type of developing apparatus comprises a toner container storing the magnetic toner, and the developing roller is supported by the toner container. The conventional developing roller comprises a hollow cylindrical sleeve made of non-magnetic material, and a magnetic shaft located inside the sleeve. The sleeve and the magnetic shaft are rotatable in synchronization with the photosensitive drum.

The sleeve is arranged parallel with the photosensitive drum. The sleeve has a peripheral surface for holding magnetic toner. The peripheral surface faces the surface of the photosensitive drum at a developing position defined between the sleeve and the photosensitive drum. The magnetic shaft has a plurality of south poles and north poles arranged alternately along the circumferential direction. The magnetic shaft is disposed inside the sleeve parallel thereto. The magnetic shaft and the sleeve are arranged coaxially such that their centers of rotation coincide with each other. Therefore, a gap, which is uniform along the circumferential direction, is formed between the sleeve and the magnetic shaft.

In the developing apparatus as described above, the magnetic toner stored in the toner container is attracted to the peripheral surface of the sleeve by the magnetic force of the magnetic shaft. The magnetic toner adhering to the peripheral surface is guided to the developing position in accordance with the rotation of the sleeve, and caused to adhere to the photosensitive drum at the developing position. As a result, the electrostatic latent image on the surface of the photosensitive drum is developed and a toner image is formed on the surface.

In the conventional developing apparatus, a biasing voltage is applied to the sleeve of the developing roller. For this reason, an electric field is generated at the developing position due to a difference between the potential of the electrostatic latent image on the photosensitive drum and the biasing voltage. A magnetic field generated by the magnetic shaft is also present at the developing position. The electric field applies force to cause the magnetic toner adhering to the peripheral surface of the sleeve to fly toward the electrostatic latent image on the photosensitive drum. To the contrary, the magnetic field applies force to keep the magnetic toner on the peripheral surface of the sleeve. At this time, since the magnetic shaft rotates within the sleeve, the south poles and the north poles alternately pass by the developing position. Therefore, an alternating magnetic field is generated at the developing position, with the result that the magnetic toner repeatedly moves between the electrostatic latent image on the photosensitive drum and the peripheral surface of the sleeve.

In the conventional developing apparatus, the radius of the magnetic shaft is smaller than that of the photosensitive drum. Accordingly, the curvature of the peripheral surface of the magnetic shaft is greater than that of the photosensitive drum. Since the conventional magnetic shaft is coaxial with the sleeve, after a point on the peripheral surface of the magnetic shaft passes by the developing position, it rapidly moves away from the surface of the photosensitive drum as the magnetic shaft rotates. Hence, at a position away from the developing position, the magnetic force applied to the electrostatic latent image on the surface of the photosensitive drum is very weak, resulting in slow movement of the magnetic toner between the electrostatic latent image and the sleeve.

Therefore, at a position away from the developing position, the magnetic toner, which should move between the electrostatic latent image on the photosensitive drum and the peripheral surface of the sleeve, floats therebetween. The floating magnetic toner is attracted to the surface of the photosensitive drum under the influence of the electric field.

As a result, the floating magnetic toner may adhere to the surface of the photosensitive drum like dots, at a position away from a region where an image is to be formed, more specifically, at a position deviated frontward from the developing position along the direction of rotation of the photosensitive drum. Since the magnetic toner dotted on the photosensitive drum is transferred to a recording paper sheet, the sheet will be stained with black.

BRIEF SUMMARY OF THE INVENTION

The present invention was made in view of the above situation. Accordingly, an object of the present invention is to provide a developing apparatus and an image forming apparatus, in which magnetic toner is prevented from adhering to the surface of the photosensitive drum at a position deviated frontward from the developing position along the direction of rotation of the sleeve, so that a satisfactory image without a stain can be obtained. To achieve the above object, according to a first aspect of the present invention, there is provided a developing apparatus comprising a rotatable hollow cylindrical sleeve and a magnetic shaft rotatable inside the hollow cylindrical sleeve, wherein the hollow cylindrical sleeve has a peripheral surface for holding magnetic toner and the peripheral surface faces the surface of a cylindrical photosensitive body at a developing position, wherein a center of rotation of the magnetic shaft is deviated from a center of rotation of the sleeve nearer to the photosensitive body and frontward along a direction of rotation of the sleeve from a reference line connecting the center of rotation of the sleeve and a center of rotation of the photosensitive body, and wherein a line connecting the center of rotation of the sleeve and the center of rotation of the magnetic shaft crosses the reference line at a crossing angle Θset within a range of 20°<Θ≦60 °. With the above structure, the magnetic shaft is closest to the peripheral surface of the sleeve at a position deviated frontward from the developing position along the direction of rotation of the sleeve. Therefore, even after a point on the magnetic shaft passes by the developing position, the magnetic force of the magnetic shaft exerted on the photosensitive body is not reduced suddenly. As a result, the magnetic force is kept as strong as that at the developing position. Thus, at a position away from the developing position, the magnetic toner existing between the sleeve and the photosensitive body can be attracted to the peripheral surface of the sleeve. In addition, according to another aspect of the present invention, the magnetic shaft has a radius R3 (mm), the cylindrical photosensitive body has a radius R2 (mm), the magnetic shaft has magnetic force G (gauss), and the radius of the magnetic shaft and the radius of the photosensitive body have a relationship that satisfies G ×(R3/R2) ≧350. With this structure, since the curvature of the magnetic shaft is small, the radius of the magnetic shaft is almost the same as that of the photosensitive body. Therefore, even after a point on the magnetic shaft passes by the developing position as the magnetic shaft rotates, it does not rapidly move away from the surface of the photosensitive body. Hence, since the magnetic force of the magnetic shaft exerted on the surface of the photosensitive body does not reduce suddenly, the magnetic toner existing between the sleeve and the photosensitive body can be attracted to the peripheral surface of the sleeve.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

A first embodiment of the present invention will be described with reference to FIGS. 1 to 5.

Figure 1:
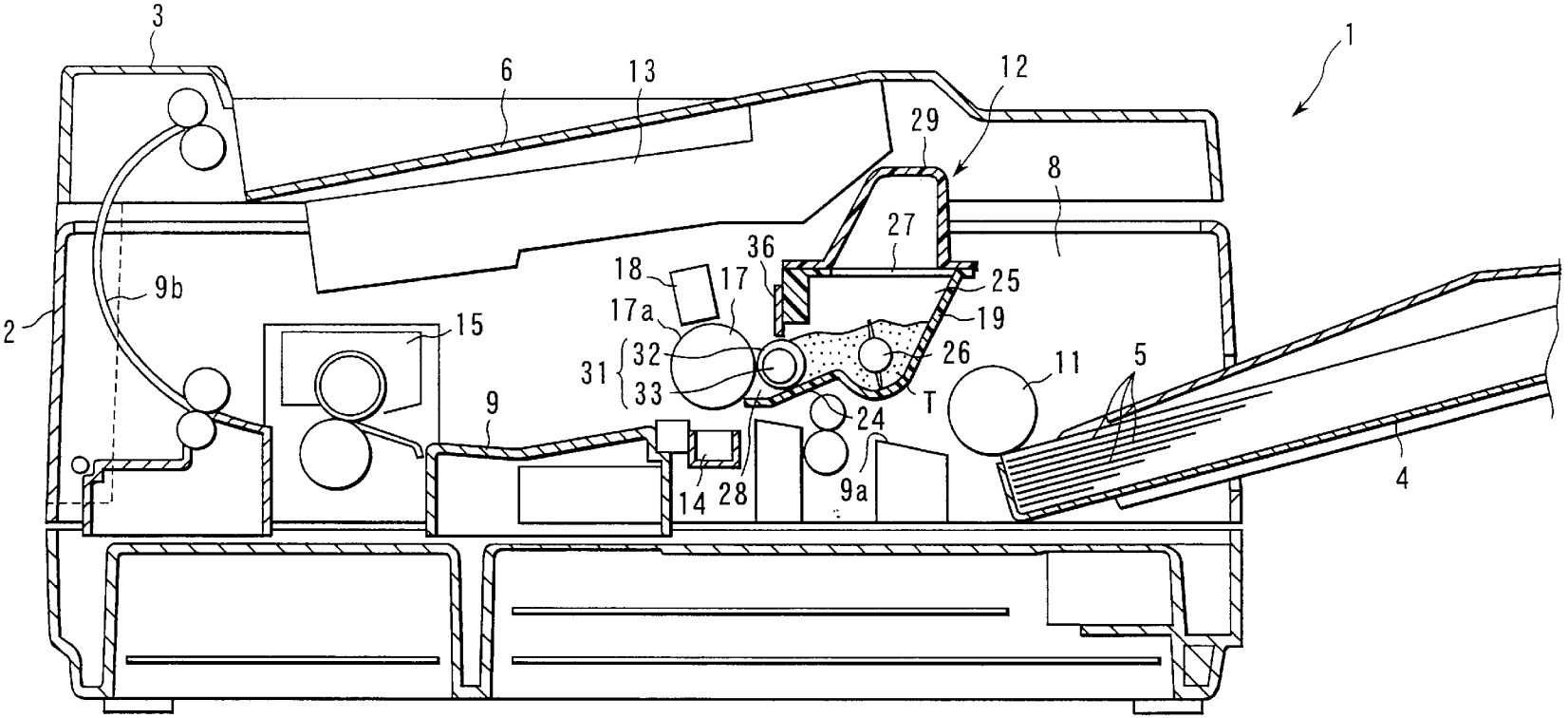
FIG. 1 is a cross-sectional view schematically showing a structure of an image forming apparatus according to a first embodiment of the present invention.

FIG. 1 schematically shows the overall structure of an image forming apparatus 1 used as, for example, a printer. The image forming apparatus 1 comprises an apparatus body 2 and a top cover 3. The apparatus body 2 has a paper feed cassette 4 on one side portion thereof. Recording paper sheets 5, serving as a recording media, are stacked in the paper feed cassette 4. The top cover 3 is rotatably supported by the apparatus body 2 between a first position at which the top cover 3 fits to the top of the apparatus body 2 and a second position at which it is apart from the apparatus body 2. The top cover 3 has a stacker table 6 for receiving recording paper sheets 5.

The apparatus body 2 comprises a device accommodating chamber 8. The device accommodating chamber 8 opens at a top end of the apparatus body 2, and is opened and closed by the top cover 3. The device accommodating chamber 8 includes a transfer path 9. The transfer path 9, for transferring a recording paper sheet 5 from the paper feed cassette 4 to the stacker table 6, comprises a plurality of rollers and guide plates. The transfer path 9 has a first-half portion 9*a* connected to the paper feed cassette 4 and a second-half portion 9*b* connected to the stacker table 6. The first-half portion 9*a* extends horizontally in the device accommodating chamber 8. The second-half portion 9*b* extends up toward the stacker table 6 from the termination of the first-half portion 9*a*.

As shown in FIG. 1, the device accommodating chamber 8 accommodates a paper feed roller 11, an image processing unit 12, an exposing apparatus 13, a transferring apparatus 14 and a fixing apparatus 15.

The paper feed roller 11 feeds recording paper sheets 5, stacked in the paper feed cassette 4, one by one to the transfer path 9. It is located at the beginning of the first-half portion 9*a*. The image processing unit 12 is located above the first-half portion 9*a* of the transfer path 9, and detachably supported by the apparatus body 2.

The image processing unit 12 comprises a photosensitive drum 17, a charging apparatus 18 and a developing apparatus 19. The photosensitive drum 17, having a cylindrical surface 17*a* on which an electrostatic latent image is formed, is arranged horizontally along a direction perpendicular to the direction in which the recording paper sheet 5 is transferred. The photosensitive drum 17 is rotated clockwise as indicated by the arrows in FIGS. 3 to 5. The charging apparatus 18, for charging the surface 17*a* of the photosensitive drum 17, is located above the photosensitive drum 17. The developing apparatus 19 develops the electrostatic latent image formed on the surface 17*a* of the photosensitive drum 17 to form a toner image. The developing apparatus 19 and the photosensitive drum 17 are detachably connected.

The exposing apparatus 13 radiates an optical signal corresponding to an image signal to the surface 17*a* of the photosensitive drum 17, thereby forming an electrostatic latent image on the surface 17*a*. The exposing apparatus 13, supported by the top cover 3, is located above the image processing unit 12.

The transferring apparatus 14 transfers the toner image formed on the surface 17*a* of the photosensitive drum 17 to the recording paper sheet 5. The transferring apparatus 14 faces the photosensitive drum 17 with the transfer path 9 interposed therebetween. The fixing apparatus 15, for fixing the toner image transferred to the recording paper sheet 5, is located at the termination of the first-half portion 9*a* of the transfer path 9.

Figure 2:
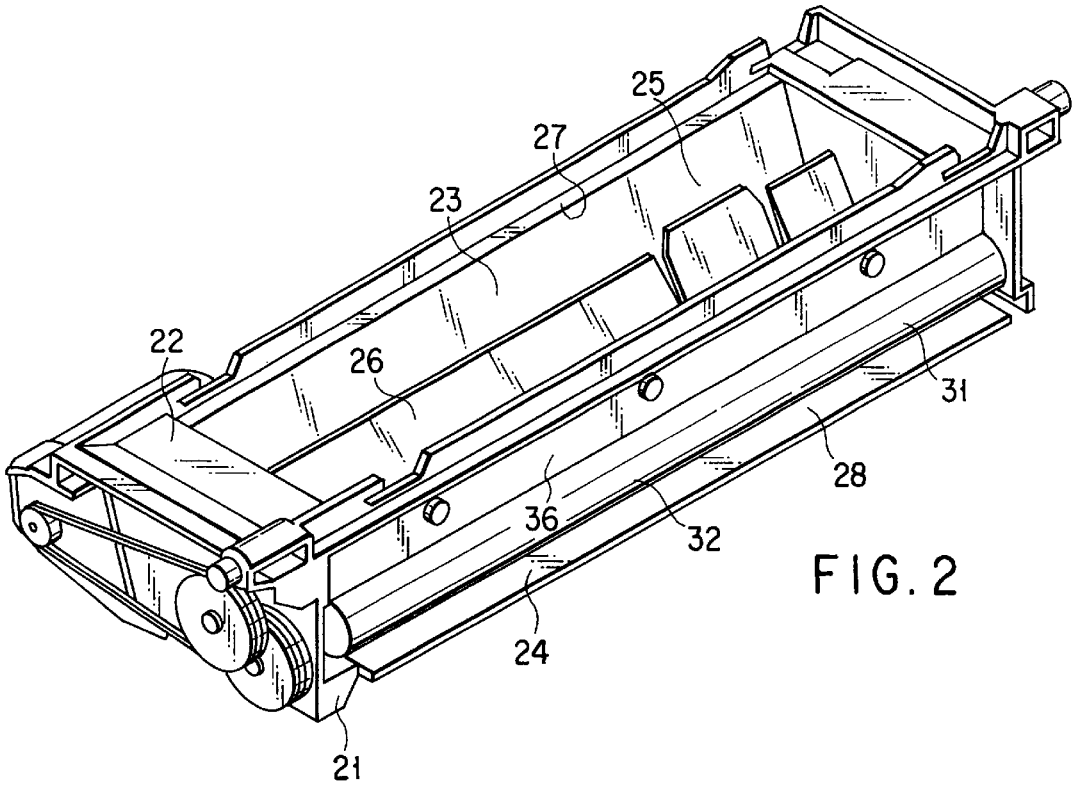
FIG. 2 is a perspective view of a developing apparatus according to the first embodiment, which shows a positional relationship between a toner container and a developing roller.
Figure 3:
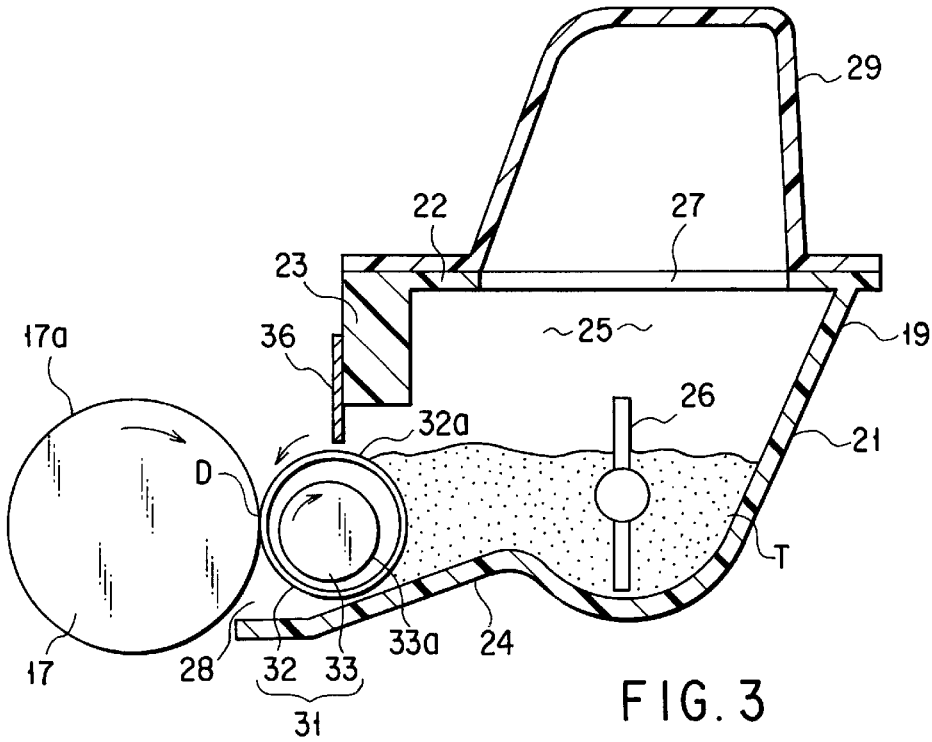
FIG. 3 is a cross-sectional view of the developing apparatus according to the first embodiment.

The developing apparatus 19 for developing the electrostatic latent image comprises a toner container 21 as shown in FIGS. 2 and 3. The toner container 21 is arranged parallel to the photosensitive drum 17 and shaped as a box extending in the axial direction of the photosensitive drum 17. The toner container 21 has an upper wall 22, a peripheral wall 23 and a bottom wall 24. These walls 22 to 24 constitute a toner storing chamber 25 for storing magnetic toner T in the toner container 21. The toner storing chamber 25 contains a mixer 26 for mixing the magnetic toner T.

The toner container 21 has a toner replenishing port 27 formed in the upper wall 22 and a toner supplying port 28 formed in the peripheral wall 23. The toner replenishing port 27 and the toner supplying port 28, each having a long and narrow shape extending in the longitudinal direction of the toner container 21, communicate with the toner storing chamber 25. A toner cartridge 29 is arranged above the toner container 21. The toner cartridge 29, for replenishing the toner storing chamber 25 with the magnetic toner T through the toner replenishing port 27, is removably supported by the upper wall 22 of the toner container 21.

The toner supplying port 28 faces the photosensitive drum 17. A developing roller 31 is arranged in the toner supplying port 28. The developing roller 31 is equal in length to the photosensitive drum 17 and arranged parallel to the photosensitive drum 17.

The developing roller 31 comprises a sleeve 32 made of non-magnetic material, and a magnetic shaft 33. The sleeve 32 has a hollow cylindrical shape. The radius R1 of the sleeve 32 is smaller than the radius R2 of the photosensitive drum 17. The sleeve 32 is rotatably supported by the toner container 21. As indicated by the arrows in FIGS. 4 and 5, the sleeve 32 is rotated counterclockwise, i.e., in the direction opposite to that of rotation of the photosensitive drum 17. A biasing voltage is applied to the sleeve 32.

The sleeve 32 has a peripheral surface 32*a* for holding the magnetic toner T. A half, in the circumferential direction, of the peripheral surface 32*a* is exposed to the toner storing chamber 25. The remaining portion of the peripheral surface 32*a* is exposed outside the toner container 21 through the toner supplying port 28. The portion of the peripheral surface 32*a* of the sleeve 32, which is exposed outside the toner container 21, faces the surface 17*a* of the photosensitive drum 17. The peripheral surface 32*a* of the sleeve 32 and the surface 17*a* of the photosensitive drum 17 get closest to each other at a developing position D, where the electrostatic latent image on the surface 17*a* of the photosensitive drum 17 is developed. At the developing position D, there is a small gap g between the peripheral surface 32*a* of the sleeve 32 and the surface 17*a* of the photosensitive drum 17.

The magnetic shaft 33, having a cylindrical shape, is enclosed within the sleeve 32. The radius R3 of the magnetic shaft 33 is smaller than the radius R1 of the sleeve 32. The magnetic shaft 33 is rotatably supported by the toner container 21. As indicated by the arrows in FIGS. 4 and 5, the magnetic shaft 33 is rotated clockwise, i.e., in the direction opposite to that of rotation of the sleeve 32. The magnetic shaft 33 has a plurality of north poles 34 and south poles 35 arranged alternately along the circumferential direction. Therefore, the magnetic toner T is attracted to the peripheral surface 32*a* of the sleeve 32 by the magnetic force of the magnetic shaft 33. At this time, the particles of the toner T are kept standing on the peripheral surface 32*a*, for example, like ears of wheat or a rice plant.

Figure 4:
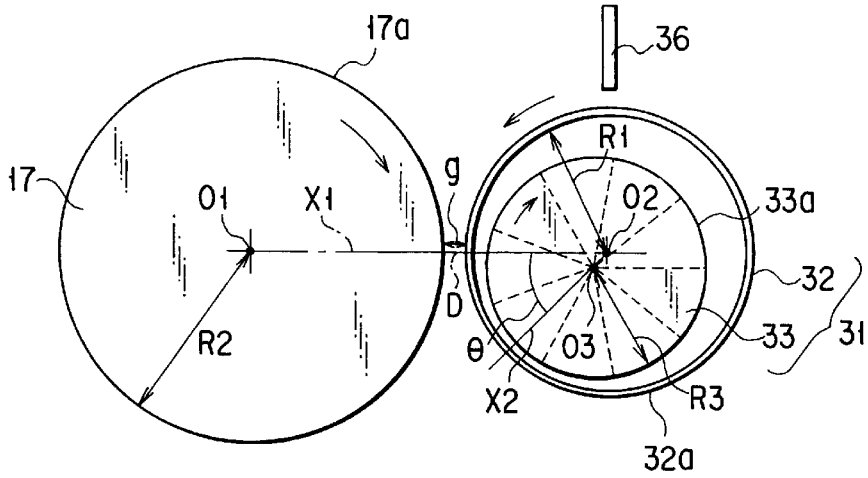
FIG. 4 is a side view of the developing apparatus according to the first embodiment, which shows a positional relationship between the developing roller and a photosensitive drum.
Figure 5:
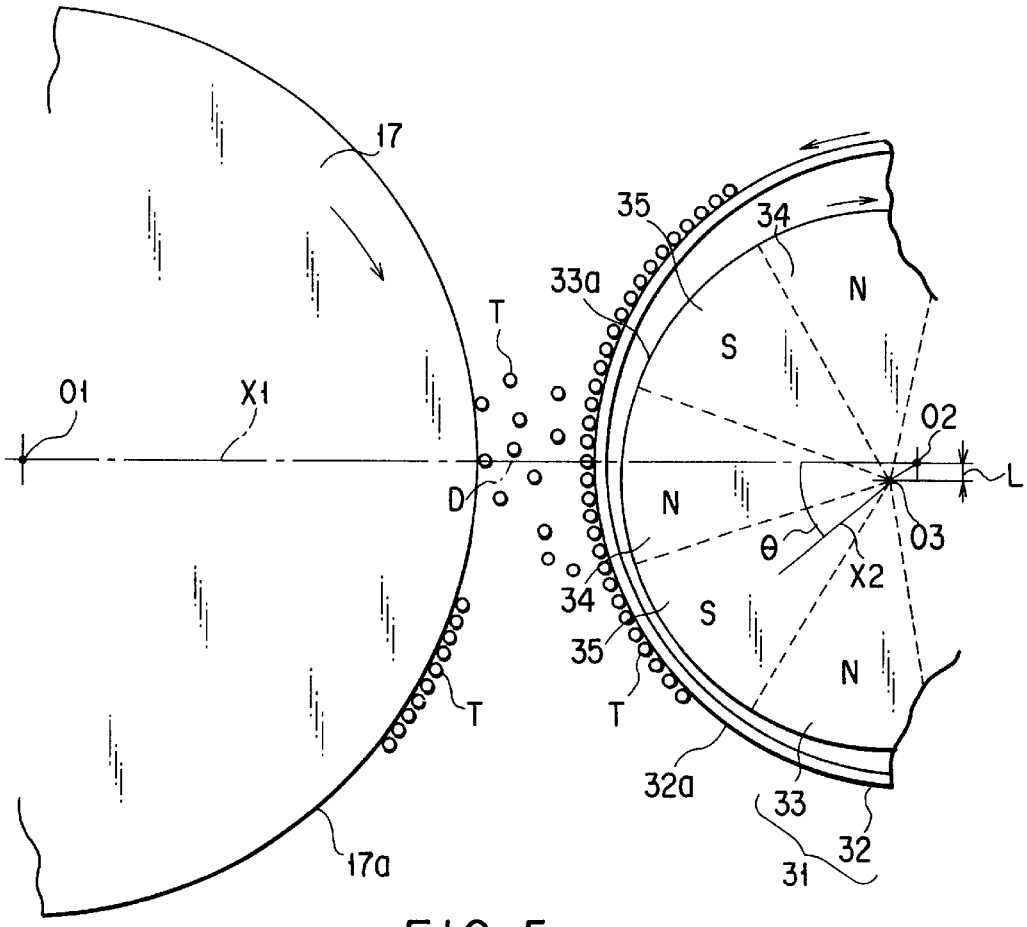
FIG. 5 is a side view showing movement of magnetic toner between the developing roller and the photosensitive drum in the first embodiment.

As shown in FIGS. 4 and 5, the center of rotation O1 of the photosensitive drum 17 and the center of rotation O2 of the sleeve 32 are located on a horizontal reference line X1. Therefore, the photosensitive drum 17 and the sleeve 32 of the developing roller 31 are arranged side by side in the horizontal direction and the developing position D is located on the reference line X1.

The magnetic shaft 33 is arranged parallel and eccentric with respect to the sleeve 32. More specifically, the center of rotation O3 of the magnetic shaft 33 is deviated from the center of rotation O2 of the sleeve 32 nearer to the photosensitive drum 17, and downward from the reference line X1 by a distance L. Therefore, a peripheral surface 33*a* of the magnetic shaft 33 is closest to the peripheral surface 32*a* of the sleeve 32 at a position slightly deviated frontward from the developing position D along the direction of rotation of sleeve 32. Moreover, since the magnetic shaft 33 is eccentric with respect to the sleeve 32, the line X2 connecting the center of rotation O2 of the sleeve 32 and the center of rotation O3 of the magnetic shaft 33 intersects the reference line X1 at a specific crossing angle θ. Therefore, the eccentricity of the magnetic shaft 33 with respect to the sleeve 32 is determined by the crossing angle θ.

As shown in FIGS. 2 and 3, a developing blade 36 is supported by the toner container 21. The developing blade 36 scrapes off an excess of the magnetic toner T adhering to the peripheral surface 32*a* of the sleeve 32, in order to form a thin toner layer on the peripheral surface 32*a*. The developing blade 36 is located above the sleeve 32 rearward of the developing position D along the direction of rotation of the sleeve 32.

In the image forming apparatus 1 having the above structure, the surface 17*a* of the photosensitive drum 17 is charged by the charging apparatus 18 while the photosensitive drum 17 is rotating. As a result, an electrostatic latent image is formed on the charged portion of the surface 17*a* by the exposing apparatus 13. The electrostatic latent image is developed by the magnetic toner T supplied from the developing apparatus 19.

The developing roller 31 of the developing apparatus 19 is located in the toner supplying port 28 of the toner container 21, and a half of the peripheral surface 32*a* of the sleeve 32 faces the toner storing chamber 25. Therefore, the magnetic toner T stored in the toner storing chamber 25 is attracted to the peripheral surface 32*a* of the sleeve 32 by the magnetic force of the magnetic shaft 33 rotating inside the sleeve 32.

The magnetic toner T adhering to the peripheral surface 32*a* of the sleeve 32 is guided to the developing blade 36 as the sleeve 32 rotates, and excess magnetic toner T is scraped off while it is passing the developing blade 36. As a result, a thin uniform toner layer is formed on the peripheral surface 32*a* of the sleeve 32. The toner layer is guided to the developing position D by the rotation of the sleeve 32, and caused to adhere to the surface 17*a* of the photosensitive drum 17 at the developing position D. Consequently, the electrostatic latent image on the surface 17*a* of the photosensitive drum 17 is developed, so that a toner image is formed on the surface 17*a*.

As the magnetic shaft 33 rotates clockwise inside the sleeve 32, the north pole 34, the south pole 35 of the magnetic shaft 33 and a weak-magnetic force portion between the adjacent poles successively pass in turn the developing position D. At this time, an electric field is generated at the developing position D due to a difference between the potential of the electrostatic latent image on the photosensitive drum 17 and the biasing voltage applied to the sleeve 32.

Assume that the force received by the magnetic toner T from the electric field is represented by Fl and the force received by the magnetized magnetic toner T from the magnetic field of the magnetic shaft 33 is represented by F2. In this case, when the north pole 34 and the south pole 35 of the magnetic shaft 33 pass the developing position D, the relationship F1<F2 is established. Therefore, feedback force is exerted on the magnetic toner T to cause it to be attracted to the sleeve 32. On the other hand, when the weak-magnetic force portion between the adjacent poles of the magnetic shaft 33 passes the developing position D, the relationship Fl>F2 is established. Therefore, flying force is exerted on the magnetic toner T to cause it to fly toward the electrostatic latent image on the photosensitive drum 17. As a result, an alternating magnetic field is generated at the developing position D as the magnetic shaft 33 rotates, with the result that the magnetic toner T repeatedly moves between the electrostatic latent image on the photosensitive drum 17 and the sleeve 32.

The magnetic shaft 33 to cause the magnetic toner T to adhere to the peripheral surface 32*a* of the sleeve 32 has a smaller radius R3 and a greater curvature of the peripheral surface as compared to the photosensitive drum 17. Therefore, if the sleeve 32 and the magnetic shaft 33 are coaxially arranged, when a point at a peripheral surface 33*a* of the magnetic shaft 33 passes by the developing position D downward under the reference line X1, it rapidly moves away from the surface 17*a* of the photosensitive drum 17. Hence, the magnetic force of the magnetic shaft 33 applied to the electrostatic latent image on the photosensitive drum 17 is considerably reduced, resulting in slow movement of the magnetic toner T between the photosensitive drum 17 and the sleeve 32.

In contrast, with the above structure of the present invention, the center of rotation O3 of the magnetic shaft 33 is deviated from the center of rotation O2 of the sleeve 32 nearer to the photosensitive drum 17 and under the developing position D (the reference line X1) by a distance L. In other words, the magnetic shaft 33 is eccentric with the sleeve 32 frontward along the direction of rotation of the sleeve 32 with reference to the developing position D.

Therefore, the magnetic shaft 33 is closest to the peripheral surface 32*a* of the sleeve 32 at a position deviated by the distance L under the reference line X1 passing through the developing position D. As a result, even after the point on the magnetic shaft 33 passes by the developing position D, the feedback force exerted on the magnetic toner T to cause it to be attracted to the sleeve 32 is not reduced. Consequently, the feedback force is kept as strong as that at the developing position D. Thus, at a position down from the developing position D, strong feedback force can be exerted on the magnetic toner T existing between the sleeve 32 and the photosensitive drum 17 to cause it to move toward the sleeve 32. Therefore, the magnetic toner T is prevented from floating between the surface 17*a* of the photosensitive drum 17 and the peripheral surface 32*a* of the sleeve 32. Accordingly, the phenomenon of the magnetic toner T being liable to adhere to the surface 17*a* due to the influence of the electric field of the photosensitive drum 17 can be considerably reduced as compared to the conventional art in which the magnetic shaft and the sleeve are coaxial with each other. For this reason, the recording paper sheet 5 does not stain and a satisfactory image can be formed on the sheet.

Table 1 indicated below shows the results of evaluation of an image recorded on the paper sheet 5, when the eccentricity of the magnetic shaft 33 determined by the crossing angle θ between the reference line X1 and the line X2 is varied.

TABLE 1

| crossing angle θ (deg) | evaluation result |
|---|---|
| −40 | X |
| −30 | X |
| −20 | X |
| −10 | X |
| 0 | X |
| 10 | Δ |
| 20 | Δ |
| 30 | ○ |
| 40 | ○ |
| 50 | ○ |
| 60 | ○ |
| 70 | Δ |
| 80 | X |

In the image processing unit 12 used to evaluate the conditions of the image, the diameter of the photosensitive drum 17 is 30 mm, the diameter of the sleeve 32 is 18 mm, the diameter of the magnetic shaft 33 is 16 mm, and a gap g formed in the developing position D is 0.35 mm. In the evaluation result shown in Table 1, the symbol ○ represents that a satisfactory image was obtained without adhesion of magnetic toner T outside the image forming region of the recording paper sheet 5. The symbol Δ represents that adhesion of a little amount of magnetic toner T outside the image forming region was observed. The symbol X represents that adhesion of much magnetic toner T outside the image forming region was observed.

According to the evaluation results, in the case where the magnetic shaft 33 is eccentric with the sleeve 32 such that the crossing angle θ is set to satisfy the following formula: $0° < \theta \leqq 60°$, a satisfactory image is obtained with substantially no magnetic toner T adhering to the recording paper sheet 5 outside the image forming region. Particularly when the magnetic shaft 33 is eccentric with the sleeve 32 such that the crossing angle θ is set to satisfy the following formula: $20° < \theta \leqq 60°$, a quality image is obtained with completely no magnetic toner T adhering to the recording paper sheet 5 outside the image forming region. Therefore, when the magnetic shaft 33 is made eccentric with the sleeve 32, it is desirable that the crossing angle θ be set within the range of $20° < \theta \leqq 60°$.

Figure 6:
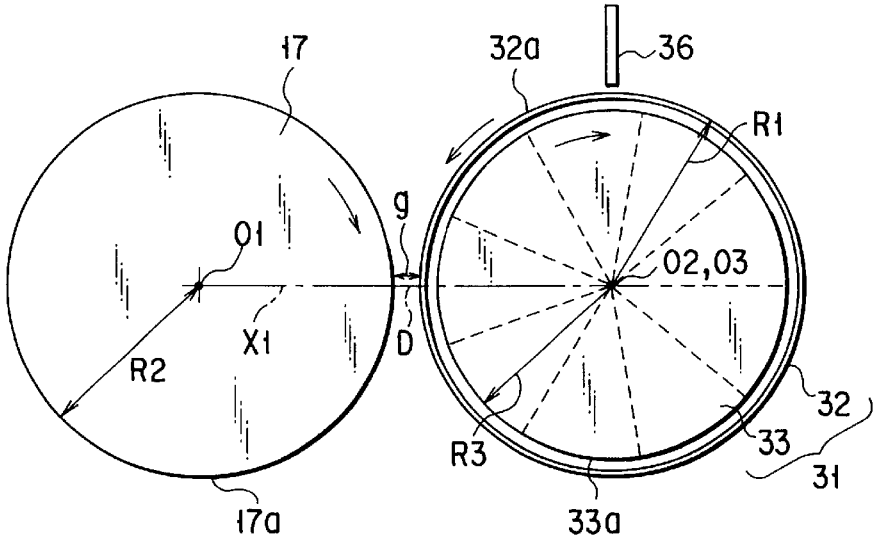
FIG. 6 is a side view of a developing apparatus according to a second embodiment, which shows a positional relationship between the developing roller and the photosensitive drum.
Figure 7:
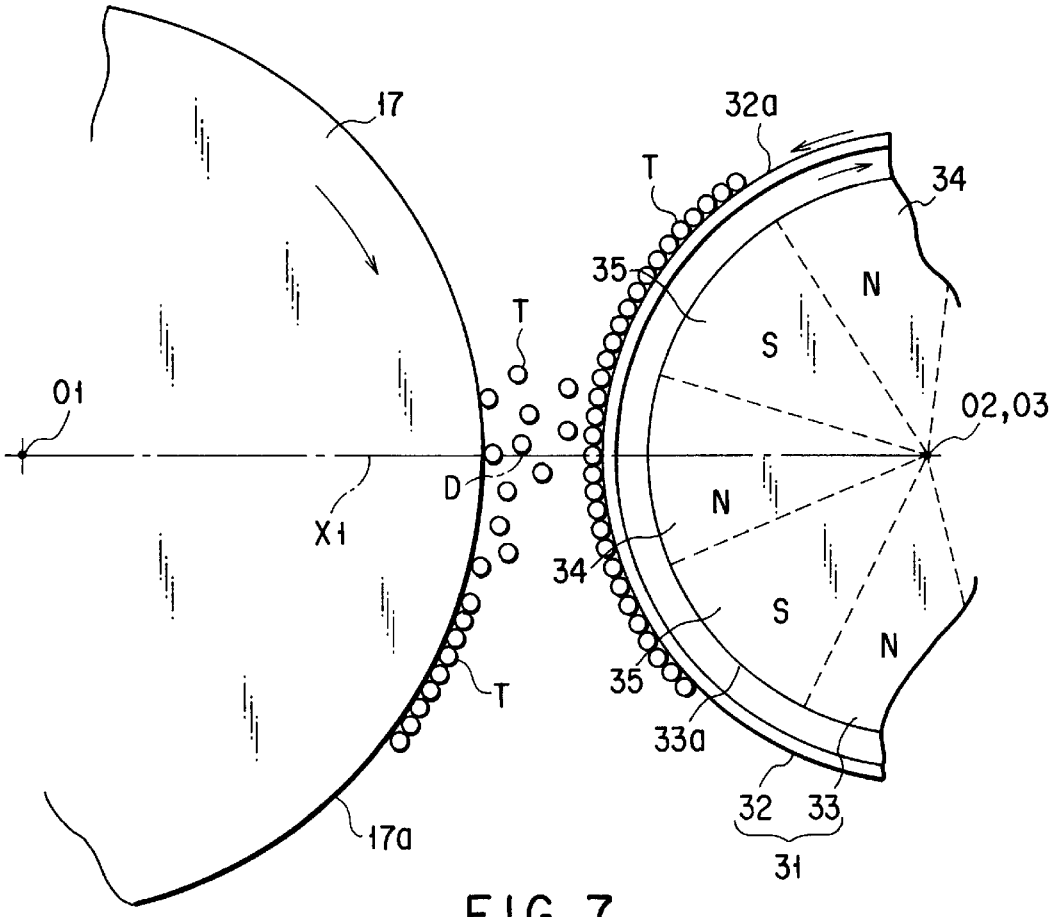
FIG. 7 is a side view showing movement of magnetic toner between the developing roller and the photosensitive drum in the second embodiment.

FIGS. 6 and 7 show a second embodiment of the present invention.

The second embodiment is different from the first embodiment in that the sleeve 32 and the magnetic shaft 33 are arranged coaxially. The other structure of the image processing unit 12 is basically the same as that of the first embodiment. Therefore, in the following, the structural parts that are the same as those of the first embodiment are identified by the same reference symbols as those for the first embodiment, and detailed description thereof are omitted.

As shown in FIG. 6, the center of rotation O2 of the sleeve 32 and the center of rotation O3 of the magnetic shaft 33 are located on the same horizontal line. The radius R3 of the magnetic shaft 33 and the radius R2 of the photosensitive drum 17 are set to satisfy the following formula: G×(R3/R2)≧350, where G (gauss) represents the magnetic force of the magnetic shaft 33. In the second embodiment, the relationship between the radius R3 of the magnetic shaft 33 and the radius R2 of the photosensitive drum 17 is determined using the magnetic force G as a parameter, so that, even at a point on the magnetic shaft 33 away from the developing position D, the feedback force to attract the magnetic toner T to the sleeve 32 can be kept equivalent to that at the developing position D.

With this structure, at a point on the magnetic shaft 33 away from the developing position D, the feedback force to attract the magnetic toner T to the sleeve 32 is not reduced. Accordingly, the magnetic toner T between the surface 17*a* of the photosensitive drum 17 and the peripheral surface 32*a* of the sleeve 32 is prevented from floating. Therefore, the magnetic toner T does not easily adhere to the surface 17*a* of the photosensitive drum 17 at a position away from the developing position D. Consequently, as in the case of the first embodiment, the recording paper sheet 5 does not stain and a satisfactory image can be formed on the sheet.

Table 2 indicated below shows the results of evaluation of an image recorded on the paper sheet 5, when the radius R3 of the magnetic shaft 33 is varied.

TABLE 2

| magnetic force | evaluation result | | | | | | | | |
|---|---|---|---|---|---|---|---|---|---|
| (R3/R2) | 300 | 350 | 400 | 450 | 500 | 550 | 600 | 650 | 700 |
| 0.6 | X | X | X | X | X | X | Δ | Δ | ○ |
| 0.8 | X | X | X | Δ | ○ | ○ | ○ | ○ | ○ |
| 1.0 | X | Δ | ○ | ○ | ○ | ○ | ○ | ○ | ○ |
| 1.2 | Δ | ○ | ○ | ○ | ○ | ○ | ○ | ○ | ○ |

In the evaluation result shown in Table 2, the symbol ○ represents that a satisfactory image was obtained without adhesion of magnetic toner T outside the image forming region of the recording paper sheet 5. The symbol Δ represents that adhesion of a little amount of magnetic toner T outside the image forming region was observed. The symbol X represents that adhesion of much magnetic toner T outside the image forming region was observed.

According to the evaluation results, in the case where the radius R3 of the magnetic shaft 33 and the radius R2 of the photosensitive drum 17 are determined so as to satisfy the formula G×(R3/R2)≧350, where G is a parameter representing the magnetic force of the magnetic shaft 33, a satisfactory image is obtained with substantially no magnetic toner T adhering to the recording paper sheet 5 outside the image forming region. Particularly when the radius R3 of the magnetic shaft 33 and the radius R2 of the photosensitive drum 17 satisfy the formula G×(R3/R2)≧400, a quality image is obtained with completely no magnetic toner T adhering to the recording paper sheet 5 outside the image forming region. Therefore, when the magnetic shaft 33 and the sleeve 32 are coaxially arranged, it is desirable that the radius R3 of the magnetic shaft 33 and the radius R2 of the photosensitive drum 17 be determined so as to satisfy the formula G×(R3/R2)≧400.

Figure 8:
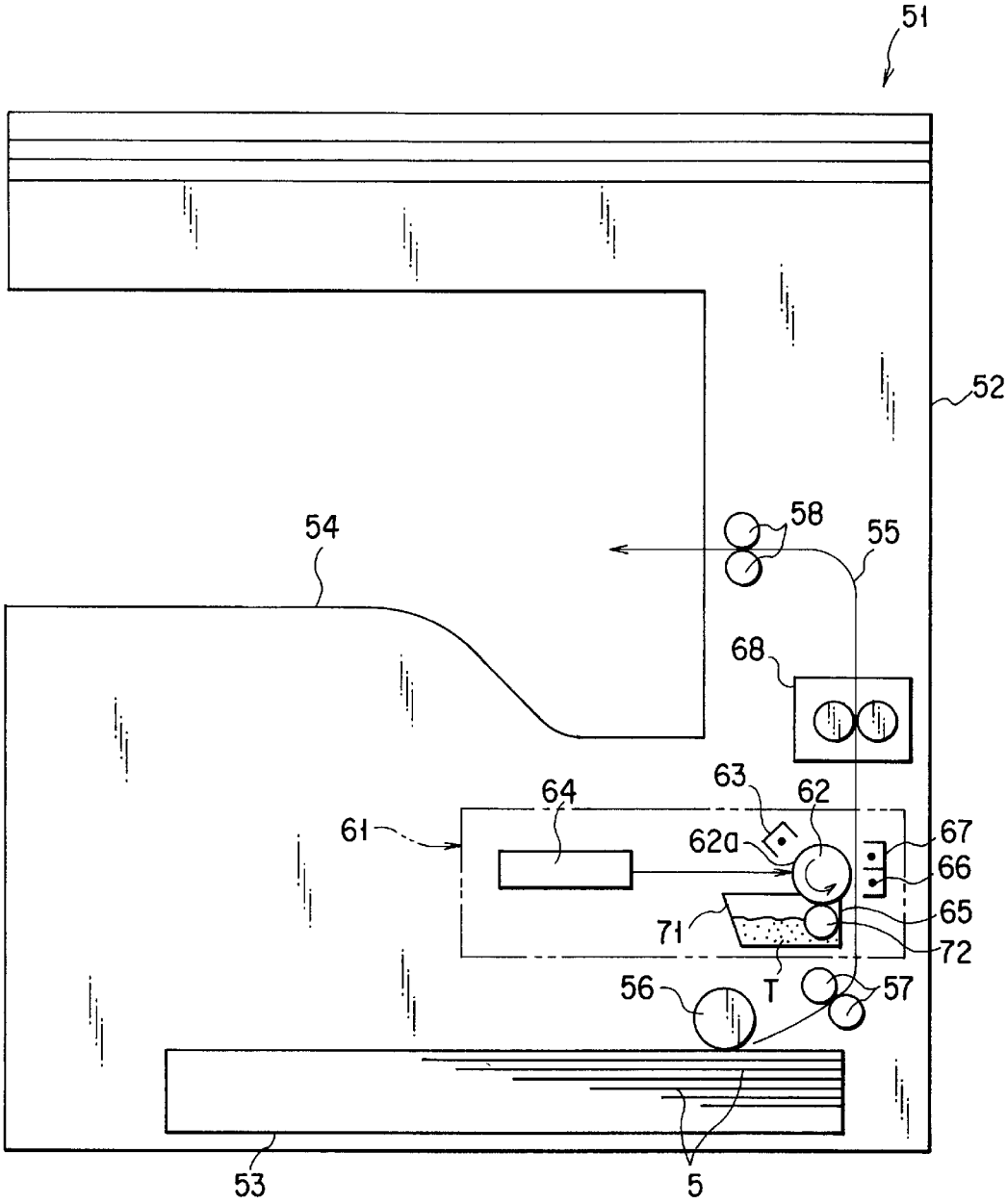
FIG. 8 is a cross-sectional view schematically showing a structure of an image forming apparatus according to a third embodiment of the present invention.
Figure 9:
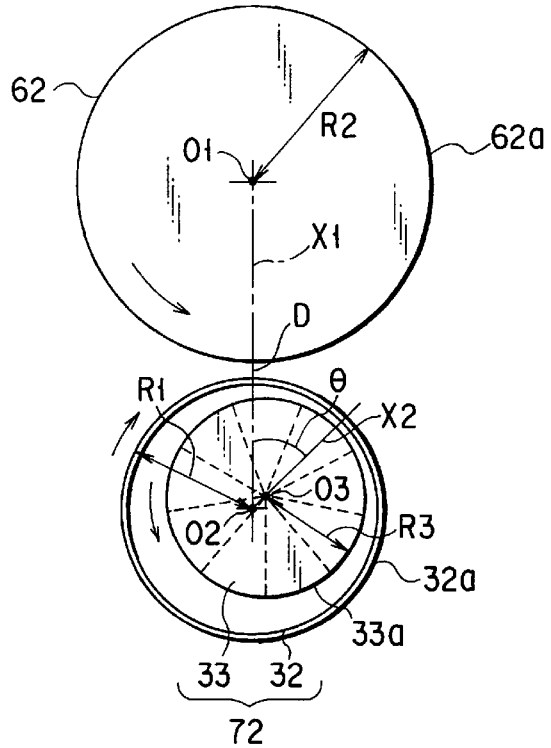
FIG. 9 is a side view of the developing apparatus according to the third embodiment, which shows a positional relationship between the developing roller and the photosensitive drum.
Figure 10:
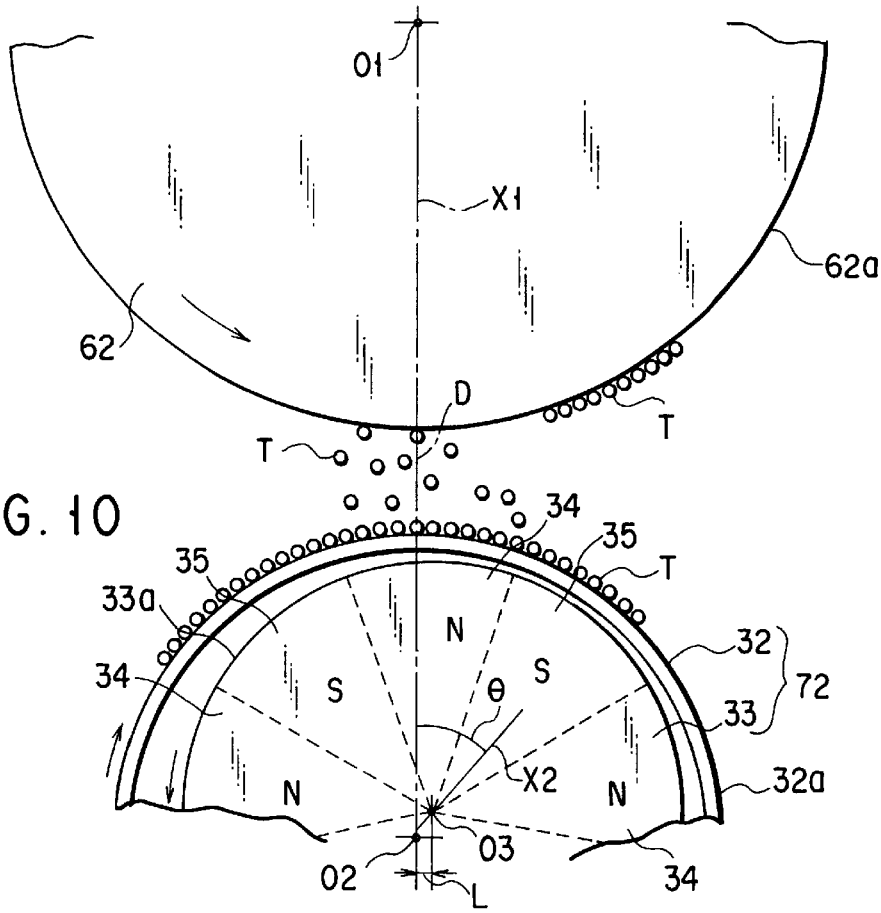
FIG. 10 is a side view showing movement of magnetic toner between the developing roller and the photosensitive drum in the third embodiment.

FIGS. 8 to 10 show a third embodiment of the present invention.

In an image processing apparatus 51 of the third embodiment, a recording paper sheet 5 is transferred in a vertical direction. As shown in FIG. 8, the image processing apparatus 51 comprises a box-shaped apparatus body 52. The apparatus body 52 includes a paper feed cassette 53 for storing recording paper sheets 5 and a stacker portion 54 for receiving recording paper sheets 5. The paper feed cassette 53 is located on a bottom portion of the apparatus body 52 and the stacker portion 54 is located above the paper feed cassette 53. The apparatus body 52 has a transfer path 55. The transfer path 55, for transferring a recording paper sheet 5 from the paper feed cassette 53 to the stacker portion 54, is arranged vertically in the apparatus body 52. The transfer path 55 includes a paper feed roller 56, transfer rollers 57 and paper ejection rollers 58. The paper feed roller 56 feeds the recording paper sheets 5, stacked in the paper feed cassette 53, one by one to the transfer path 55. It is located at the beginning of the transfer path 55. The transfer rollers 57 are located downstream from the paper feed roller 56 along the direction of transfer of the recording paper sheet 5, 50 that they transfer upward the paper sheet 5 which has been fed into the transfer path 55. The paper ejection rollers 58 eject the recording paper sheets 5 transferred through the transfer path 55 to the transfer path 55. The apparatus body 52 contains an image processing mechanism 61. The image processing mechanism 61 is located in the midstream of the transfer path 55. The image processing mechanism 61 comprises a photosensitive drum 62, a charging apparatus 63, an exposing apparatus 64, a developing apparatus 65, a transferring apparatus 66 and a destaticizing apparatus 67. The photosensitive drum 62 has a cylindrical surface 62*a* on which an electrostatic latent image is formed. It is arranged horizontally in a lower portion of the transfer path 55 along a direction perpendicular to the direction in which the recording paper sheet 5 is transferred. The photosensitive drum 62 is rotated counterclockwise as indicated by the arrows in FIGS. 9 and 10. The charging apparatus 63, the exposing apparatus 64, the developing apparatus 65, the transferring apparatus 66 and the destaticizing apparatus 67 are arranged around the photosensitive drum 62. A fixing apparatus 68 is located above the photosensitive drum 62 in an upper portion of the transfer path 55.

The developing apparatus 65 for developing an electrostatic latent image comprises a toner container 71 for storing magnetic toner T and a developing roller 72 for supplying the magnetic toner T from the toner container 71 to the photosensitive drum 62. The developing roller 72 is arranged under the photosensitive drum 62 in parallel thereto.

As shown in FIGS. 9 and 10, the developing roller 72 has the same structure as in the first embodiment. It comprises a hollow cylindrical sleeve 32 and a magnetic shaft 33 contained in the sleeve 32. The peripheral surface 32*a* of the sleeve 32 faces the surface 62*a* of the photosensitive drum 62. The peripheral surface 32*a* of the sleeve 32 and the surface 62*a* of the photosensitive drum 62 get closest to each other at a developing position D, where the electrostatic latent image is developed.

The center of rotation O1 of the photosensitive drum 62 and the center of rotation O2 of the sleeve 32 are located on a vertical reference line X1. The center of rotation O3 of the magnetic shaft 33 is deviated from the center of rotation O2 of the sleeve 32 nearer to the photosensitive drum 62, and sideways from the reference line X1 by a distance L. Therefore, a peripheral surface 33*a* of the magnetic shaft 33 is closest to the peripheral surface 32*a* of the sleeve 32 at a position slightly deviated frontward from the developing position D along the direction of rotation of sleeve 32. Moreover, since the magnetic shaft 33 is eccentric with respect to the sleeve 32, the line X2 connecting the center of rotation O2 of the sleeve 32 and the center of rotation O3 of the magnetic shaft 33 intersects the reference line X1 at a specific crossing angle θ.

With the above structure, the magnetic shaft 33 is closest to the peripheral surface 32*a* of the sleeve 32 at a position deviated by the distance L sideway from the reference line X1 passing through the developing position D. As a result, even after a point on the magnetic shaft 33 passes by the developing position D, the feedback force exerted on the magnetic toner T to cause it to be attracted to the sleeve 32 is not reduced. Consequently, the feedback force is kept as strong as that at the developing position D.

Thus, in the case where the photosensitive drum 62 and the developing roller 72 are arranged one on the other, the magnetic toner T is prevented from floating at a position away from the developing position D. Accordingly, the phenomenon of the magnetic toner T being liable to adhere to the surface 62*a* of the photosensitive drum 62 can be considerably reduced. For this reason, as well as in the first embodiment, the recording paper sheet 5 is not stained with the toner T and a satisfactory image can be formed on the sheet.

In the case where the photosensitive drum 62 and the developing roller 72 are arranged one on the other, the relationship between the radius R3 of the magnetic shaft 33 and the radius R2 of the photosensitive drum 72 may be determined to satisfy the following formula: $G\times(R3/R2)\geqq 350$, using the magnetic force G as a parameter, as in the case of the second embodiment.

With this structure, although the sleeve 32 and the magnetic shaft 33 are coaxially arranged, the feedback force to attract the magnetic toner T to the sleeve 32 is not reduced even at a point on the magnetic shaft 33 away from the developing position D. Consequently, the recording paper sheet 5 is not stained with the magnetic toner T.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A developing apparatus for developing an electrostatic latent image formed on a surface of a cylindrical photosensitive body by using magnetic toner, said developing apparatus comprising:

a rotationally driven hollow cylindrical sleeve having a peripheral surface which holds the magnetic toner and which faces the surface of the photosensitive body at a developing position; and a rotationally driven magnetic shaft disposed inside the sleeve for causing the magnetic toner to adhere to the peripheral surface of the sleeve by magnetic force, wherein the magnetic toner which adheres to the peripheral surface is supplied to the developing position by rotation of the sleeve, wherein the magnetic toner which adheres to the peripheral surface is supplied to the developing position by rotation of the sleeve, wherein a center of rotation of the magnetic shaft is deviated from a center of rotation of the sleeve nearer to the photosensitive body, and frontward along a direction of rotation of the sleeve from a reference line connecting the center of rotation of the sleeve and a center of rotation of the photosensitive body, and wherein a line connecting the center of rotation of the sleeve and the center of rotation of the magnetic shaft crosses the reference line at a crossing angle θ set within a range of $20°\Theta\leqq 60°$.

2. A developing apparatus according to clam 1, wherein the sleeve has a radius smaller than a radius of the photosensitive body, and the magnetic shaft has a radius smaller than the radius of the sleeve.

3. A developing apparatus according to claim 1, wherein the magnetic shaft has a plurality of north poles and south poles arranged alternately along a circumferential direction, and wherein the north poles and south poles alternately cross the developing position as the magnetic shaft rotated, thereby generating an alternating magnetic field at the developing position, so that the magnetic toner is moved between the photosensitive body and the sleeve.

4. A developing apparatus according to claim 1, further comprising a toner container for storing the magnetic toner, wherein the toner container has a toner supplying port facing the photosensitive body, and the sleeve is located at the toner supplying port of the toner container.

5. A developing apparatus for developing an electrostatic latent image formed on a surface of a cylindrical photosensitive body by using magnetic toner, said developing apparatus comprising:

a rotationally driven hollow cylindrical sleeve having a peripheral surface which holds the magnetic toner and which faces the surface of the photosensitive body at a developing position; and a rotationally driven magnetic shaft disposed inside the sleeve for causing the magnetic toner to adhere to the peripheral surface of the sleeve by magnetic force, wherein the magnetic toner which adheres to the peripheral surface is supplied to the developing position by rotation of the sleeve, wherein the magnetic shaft has a radius R3 (mm), the photosensitive body has a radius R2 (mm), and the magnetic shaft has magnetic force G (gauss), and wherein the radius of the magnetic shaft and the radius of the photosensitive body have a relationship that satisfies $G\times(R3/R2)\geqq 350$ .

6. A developing apparatus according to claim 5, wherein the magnetic shaft and the sleeve are coaxially disposed.

7. A developing apparatus according to claim 5, wherein the magnetic shaft has a plurality of north poles and south poles arranged alternately along a circumferential direction, and wherein the north poles and south poles alternately cross the developing position as the magnetic shaft rotates, thereby generating an alternating magnetic field at the developing position, so that the magnetic toner is moved between the photosensitive body and the sleeve.

8. An image processing unit comprising:

a photosensitive body having a circumferential surface on which an electrostatic latent image is formed; and a developing apparatus for developing the electrostatic latent image by using magnetic toner, said developing apparatus comprising:

a rotationally driven hollow cylindrical sleeve having a peripheral surface which holds the magnetic toner and which faces the surface of the photosensitive body at a developing position; and a rotationally driven magnetic shaft disposed inside the sleeve for causing the magnetic toner to adhere to the peripheral surface of the sleeve by magnetic force, wherein the magnetic toner which adheres to the peripheral surface is supplied to the developing position by rotation of the sleeve, wherein a center of rotation of the magnetic shaft is deviated from a center of rotation of the sleeve nearer to the photosensitive body, and frontward along a direction of rotation of the sleeve from a reference line connecting the center of rotation of the sleeve and a center of rotation of the photosensitive body, and wherein a line connecting the center of rotation of the sleeve and the center of rotation of the magnetic shaft crosses the reference line at a crossing angle G set within a range of $20° < \Theta \leqq \alpha°$.

9. An image processing unit comprising:

a photosensitive body having a surface on which an electrostatic latent image is formed; and a developing apparatus for developing the electrostatic latent image by using magnetic toner, said developing apparatus comprising:

a rotationally driven hollow cylindrical sleeve having a peripheral surface which holds the magnetic toner and which faces the surface of the photosensitive body at a developing position; and a rotationally driven magnetic shaft disposed inside the sleeve for causing the magnetic toner to adhere to the peripheral surface of the sleeve by magnetic force, wherein the magnetic toner which adheres to the peripheral surface is supplied to the developing position by rotation of the sleeve, wherein the magnetic shaft has a radius R3 (mm), the photosensitive body has a radius R2 (mm), and the magnetic shaft has magnetic force G (gauss), and wherein the radius of the magnetic shaft and the radius of the photosensitive body have a relationship that satisfies $G \times (R3/R2) \geqq 350$.

10. An image forming apparatus comprising:

an apparatus body having a transfer path through which a sheet-like recording medium is transferred;

a photosensitive body disposed in the transfer path and having a surface on which an electrostatic latent image is formed; and a developing apparatus for causing magnetic toner to adhere to the electrostatic latent image, thereby forming a toner image, said developing apparatus comprising:

a rotationally driven hollow cylindrical sleeve having a peripheral surface which holds the magnetic toner and which faces the surface of the photosensitive body at a developing position; and a rotationally driven magnetic shaft disposed inside the sleeve for causing the magnetic toner to adhere to the peripheral surface of the sleeve by magnetic force, wherein the magnetic toner which adheres to the peripheral surface is supplied to the developing position by rotation of the sleeve, wherein a center of rotation of the magnetic shaft is deviated from a center of rotation of the sleeve nearer to the photosensitive body, and frontward along a direction of rotation of the sleeve from a reference line connecting the center of rotation of the sleeve and a center of rotation of the photosensitive body, and wherein a line connecting the center of rotation of the sleeve and the center of rotation of the magnetic shaft crosses the reference line at a crossing angle θ set within a range of $20° < \Theta \leqq 60°$.

11. A developing apparatus according to claim 10, wherein the sleeve has a radius smaller than a radius of the photosensitive body and the magnetic shaft has a radius smaller than the radius of the sleeve.

12. An image forming apparatus comprising: an apparatus body having a transfer path through which a sheet-like recording medium is transferred;

a photosensitive body disposed in the transfer path and having a surface on which an electrostatic latent image is formed; and a developing apparatus for causing magnetic toner to adhere to the electrostatic latent image, thereby forming a toner image, said developing apparatus comprising:

a rotationally driven hollow cylindrical sleeve having a peripheral surface which holds the magnetic toner and which faces the surface of the photosensitive body at a developing position; and a rotationally driven magnetic shaft disposed inside the sleeve for causing the magnetic toner to adhere to the peripheral surface of the sleeve by magnetic force, wherein the magnetic toner which adheres to the peripheral surface is supplied to the developing position by rotation of the sleeve, wherein the magnetic shaft has a radius R3 (mm), the photosensitive body has a radius R2 (mm), and the magnetic shaft has magnetic force G (gauss), and wherein the radius of the magnetic shaft and the radius of the photosensitive body have a relationship that satisfies $G \times (R3/R2) \geqq 350$.

* * * * *